US005924603A

United States Patent [19]

Santagiuliana

[11] Patent Number: 5,924,603

[45] **Date of Patent: *Jul. 20, 1999**

[54] PUMP MADE OF PLASTIC FOR DISPENSING PRODUCTS FROM CONTAINERS

[75] Inventor: Evans Santagiuliana, Vicenza, Italy

[73] Assignee: Taplast SPA, Povolaro Dueville, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/737,210

[22] PCT Filed: Mar. 11, 1996

[86] PCT No.: PCT/IB96/00391

§ 371 Date: Nov. 7, 1996

§ 102(e) Date: Nov. 7, 1996

[87] PCT Pub. No.: WO96/28257

PCT Pub. Date: Sep. 19, 1996

Related U.S. Application Data

[63] Continuation of application No. 08/455,499, May 31, 1995, Pat. No. 5,673,824.

[30] Foreign Application Priority Data

Mar. 10, 1995 [IT] Italy ..... VI95A0037

[51] Int. Cl.[6] ..... B67D 5/42

[52] U.S. Cl. ..... 222/321.1; 222/321.9; 222/336

[58] Field of Search ..... 222/207, 215, 222/321.1, 321.7, 321.9, 336, 341

[56] References Cited

U.S. PATENT DOCUMENTS

| | | | |
|---|---|---|---|
| 2,899,110 | 8/1959 | Parker | 222/215 |
| 3,124,275 | 3/1964 | Lake | 222/207 X |
| 3,223,292 | 12/1965 | Keeney et al. | 222/321.9 |
| 3,228,571 | 1/1966 | O'Donnell et al. | 222/321.9 |
| 3,235,135 | 2/1966 | Robert et al. | 222/215 X |
| 3,359,917 | 12/1967 | Cooprider | 222/321.9 X |
| 3,362,344 | 1/1968 | Deda | 222/321.9 X |
| 3,463,093 | 8/1969 | Pfeiffer et al. | 222/321.9 X |
| 4,071,172 | 1/1978 | Balogh | 222/321.7 |
| 4,252,507 | 2/1981 | Knickerbocker | 222/321.2 X |
| 5,096,094 | 3/1992 | Guilbert | 222/321.9 X |
| 5,152,435 | 10/1992 | Stand et al. | 222/321.9 X |
| 5,363,993 | 11/1994 | Mascitelli et al. | 222/321.9 |
| 5,518,147 | 5/1996 | Peterson et al. | 222/321.7 X |
| 5,544,789 | 8/1996 | Gillingham | 222/207 X |
| 5,644,703 | 7/1997 | Reifenberger et al. | 222/321.1 X |
| 5,673,824 | 10/1997 | Evans | 222/321.9 |

FOREIGN PATENT DOCUMENTS

| | | | |
|---|---|---|---|
| 404597 | 9/1966 | Australia | 222/321.7 |
| 0340724 | 2/1989 | European Pat. Off. . | |
| 0469368 A3 | 2/1992 | European Pat. Off. . | |
| 0505974 A1 | 3/1992 | European Pat. Off. . | |
| 1236720 | 6/1960 | France . | |
| 718118 | 7/1968 | France . | |
| 2380077 | 2/1977 | France . | |
| 3620897 | 12/1987 | Germany | 222/207 |
| 3909633 A1 | 10/1990 | Germany . | |
| 39285241 A1 | 3/1991 | Germany . | |
| 4-04267758 | 9/1992 | Japan | 222/321.9 |
| 415486 | 6/1964 | Sweden . | |
| 9408889 | 4/1994 | WIPO | 222/207 |
| 9420221 | 9/1994 | WIPO . | |

*Primary Examiner*—Kenneth Bomberg
*Attorney, Agent, or Firm*—Watson Cole Grindle Watson P.L.L.C.

[57] ABSTRACT

An all plastic pump for liquids has an elastic bellows in the shape of a spiral incorporates an integral spring. The turns of the bellows are arranged with contracted areas of the spiral formed with a protruding stiffening rib and sidewalls having a convex outwardly projection region.

18 Claims, 3 Drawing Sheets

PUMP MADE OF PLASTIC FOR DISPENSING PRODUCTS FROM CONTAINERS

CROSS REFERENCE TO RELATED APPLICATION

This application is a continuation of U.S. patent application No. 08/455,499 filed May 31, 1995 U.S. Pat. No. 5,673,824.

BACKGROUND OF THE INVENTION

The invention concerns an all plastic pump particularly suitable for dispensing liquid or thick substances from containers.

As it is known, dispensing pumps are widely used for dosing and dispensing liquid or creamy substances, such as soaps, cosmetic creams, detergents and similar. Said pumps are applied to the container which holds said substances.

The majority of the pumps used at present are made of both plastic materials and metal, the latter being mostly used for the return spring of the piston which forms the pump.

The presence of such metal materials entails some problems for recycling. In fact, should the pump be completely made of plastic materials, even differing from each other but being mutually compatible, it is possible to entirely recover the material the pump is made of, by shredding the pump directly. On the other hand, the presence of materials which are heterogeneous in relation to each other and, in particular, the presence of metal materials, prevents such a direct shredding and requires, for an eventual recycling of the plastic material, a previous separation of the metal parts. The difficulty and the costs related to such a sorting operation imply that the dispensing pumps, once they are no longer useful, are eliminated as a waste, with the inconvenience of wasting plastic material which could be recovered and of increasing the amount of non-degradable materials present among the waste.

Pumps are also known which, rather than using a spring made of metal material, use a bellows, as an elastic element made of plastic material obtained by a blow moulding process.

Said bellows element consists of a plurality of essentially toroidal elements, placed one on the other, so that the profile of the bellows, in a cross-section, presents itself as a series of expansions and contractions arranged on horizontal planes and essentially parallel in relation to each other.

Said type of profile can only be realized by blow moulding, because it is impossible to remove the snapping tool from the bellows after the moulding, and, therefore, its realization with the injection moulding process is not possible. The possibility for the bellows to be realized by injection moulding process rather than by blow moulding, would yield a number of advantages, one of which is the reduction of the production costs, since injection moulding is quicker than blow moulding.

Apart for this fact, the moulding of the bellows by injection would permit to obtain a thicker profile in the bending points which undergo a greater stress and, therefore, it would permit to realize a bellows having a higher mechanical resistance.

The realization of a bellows made of plastic material is known from the Belgian patent 718118. Said patent describes a bellows used in the field of distribution valves for the protection of the sliding elements of the valves themselves. The bellows realized according to the dictates of the mentioned patent presents its lateral surface in the shape of a spiral, so as to obtain the bellows by injection moulding since the spiral profile permits the removal of the snapping tool.

The bellows of this type present one profile of the spiral in their longitudinal section, which is not essentially symmetrical in relation to the plane of inclination of the spiral itself, so that they have a limited resistance when they undergo a pressing force because of the action of an axial stress which turns into a smaller build-up of elastic power and, therefore, into a weaker elastic return when they are released.

It easy to understand that such a fact consitutes a negative factor for the use of said bellows in the range of the pumps for dosing elements, wherein it is necessary to have forces presenting a rather consistent elastic return, since the piston of the pump, once it has gone back to its resting position after the dispensing action has been completed, must suck back the liquid in order to prearrange the pump for the next dispensing operation.

SUMMARY OF THE INVENTION

The present invention proposes to overcome such limitations.

In particular, one of the purposes of the invention is to realize a pump made of plastic for dispensing liquid or creamy substances from containers, wherein the elastic element, which ensures the return of the piston into its resting position, is an elastic bellows presenting a higher elastic coefficient against the axial pressure, as compared to elastic bellows belonging to the known technique and equivalent with it.

Another purpose is for the elastic bellows which realizes said pump to be complete with a higher elastic return as compared with equivalent bellows belonging to the known technique.

Further purpose of the invention is to realize the elastic return of the bellow without using materials different from those ones used for making the bellow. The described purposes are achieved by a pump for dosing liquids to be applied to a container which, in accordance with the main claim comprises:

- a cylindrical chamber communicating with said container through a feeding hole and suited to receive said liquid to be dispensed held inside said container;
- at least one piston axially sliding within said cylindrical chamber and provided internally with a tubular chamber;
- retaining valvular means;
- at least one elastic bellows made of plastic material and having its lateral surface in the shape of a spiral suited to ensure the return, by elastic recovery, of said pistons in their resting positions once the dispensing has occurred, and is characterized in that said elastic bellows incorporates a spring realized in a single piece with the bellows itself, the turns of which are arranged in correspondence with the contraction areas of the spiral which forms the lateral surface of the bellows, where the thickness of said turns are suited to realize a protruding stiffening rib in respect of the external surface of the spiral.

According to one preferred embodiment, the spiral which forms the lateral surface of the bellows presents, in its longitudinal section, the walls having a symmetrical profile in relation to the axis of inclination of the spiral itself.

According to one embodiment, the bellows presents a cylindrical profile.

According to another embodiment, the bellows presents a profile in the shape of a truncated-cone.

Advantageously, the presence of the spring realized in a single piece with the bellows, yields a higher elasticity to the bellows itself and also gives it a greater mechanical resistance.

Moreover, with advantage, the manufacturing of the spiral which forms the lateral surface of the bellows, which is symmetrical in relation to the axis of inclination of the spiral itself, permits to obtain a considerable elastic recovery of the bellows whenever the pump is released after the dosing.

With as much advantage, the spiral profile allows the realization of the bellows by injection moulding and permits to increase the thickness of the spiral in correspondence with the bending areas where there is a greater stress. Further scope of applicability of the present invention will become apparent from the detailed description given hereinafter.

BRIEF DESCRIPTION OF THE DRAWINGS

However, it should be understood that the detailed description and specific example, while indicating preferred embodiments of the invention, are given by way of illustration only, since various changes and modifications within the spirit and scope of the invention will become apparent to those skilled in the art from this detailed description and from the drawings, wherein:

FIGS. 9 and 10 illustrate fragmentary cross-sectional elevations of another embodiment of the invention in which the pump is shown at rest and in the dispensing position respectively.

DESCRIPTION OF THE INVENTION

Figure 1:
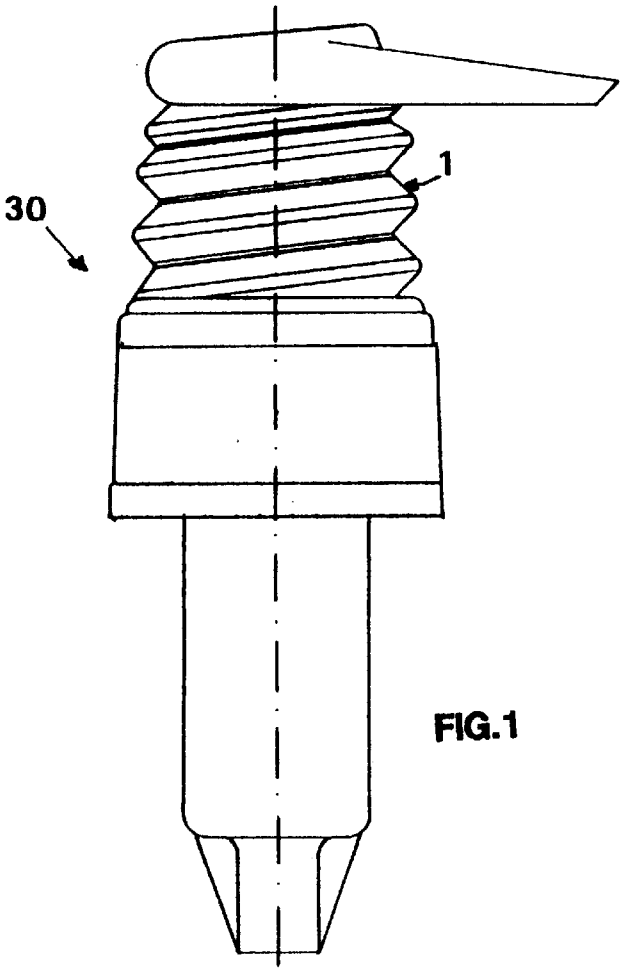
FIG. 1 shows in a perspective view the pump according to the invention.

The pump according to the invention is represented in FIG. 1, wherein is indicated as a whole with 1, and it can be observed that it comprises a cylindrical collar 11, to the lower part of which a cylindrical chamber 13 is connected, while an elastic bellows 40 is attached to its upper part. The cylindrical chamber 13 is inserted into the neck of a container, not represented in the drawing, which contains the product to be dispensed and the cylindrical collar 11 is tightened on the neck of the container itself. A dispensing element 10, provided with a dispensing inner channel 21, is connected to the upper part of the elastic bellows 40, as can also be observed in FIG. 2, and permits the dispensing of the product held in the container.

Figure 2:
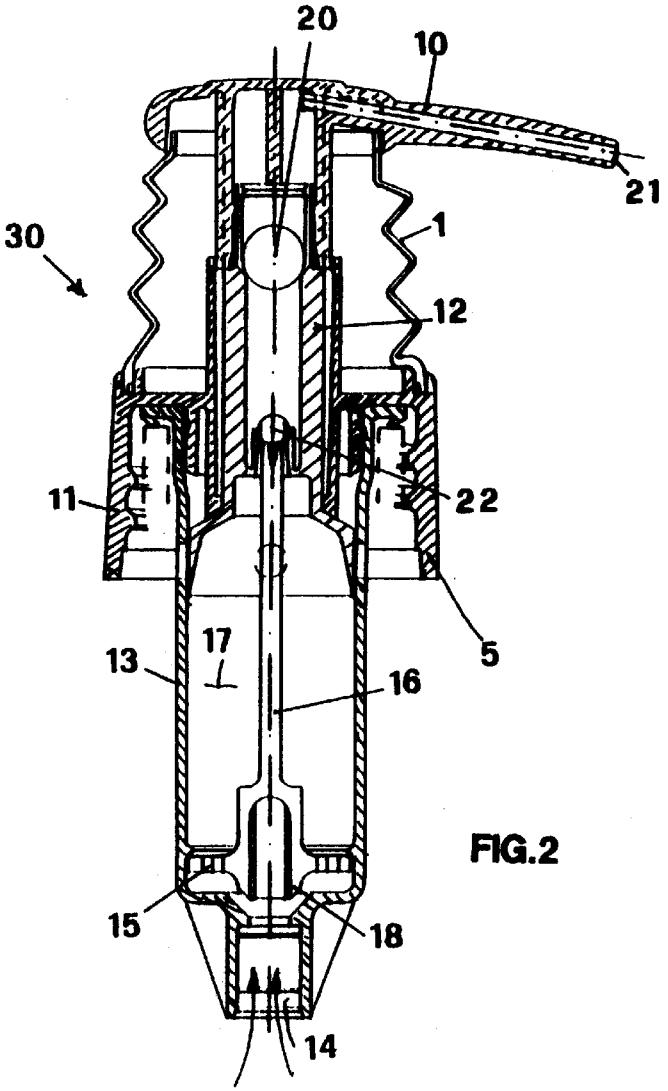
FIG. 2 shows a longitudinal section of the pump according to the invention.

In FIG. 2 it can be observed that the dispensing element 10 is connected to the tubular body 121 of a first piston 12 which slides inside said cylindrical chamber 13 communicating with the container to which the pump is connected through a feeding hole 14 drilled at the bottom 130 of said cylindrical chamber 13.

Inside said tubular body 121 a tubular chamber 160 is defined.

Stem 16 of a second piston 120 slides within said tubular chamber, said stem 16 being provided with first valvular elements consisting of a ball 22 suited to intercept duct 122 which sets into communication said tubular chamber 160 with said cylindrical chamber 13 and with second valvular elements consisting of a bevel 18 realized in the terminal part of said second piston 120.

Again in FIG. 2 it can be observed that on the opposite side of said duct 122 realized in said tubular body 121, there are third valvular means consisting of a ball 20 which intercepts the communication of said tubular chamber 160 with the dispensing channel 21 obtained in the dispensing element 10.

Finally, it can be observed that said dispensing element 10 is mechanically connected to said collar 11 by means of the interposition of said elastic bellows 40 which presents a first extremity 41 attached to said dispensing element 10 and a second extremity 42, opposite to the previous one, connected to said collar 11. Said bellows permits the mutual elastic movement of said dispensing element 10 and of said collar 11.

When the dispensing element 10 is pressed downward, it also drags downward the tubular body 121 to which it is connected, together with the first piston 12 which slides inside the cylindrical chamber 13. When said first piston 12 descends, it pushes downward said second piston 120, so that said second valvular elements 18 intercept the feeding hole 14.

When the dispensing element 10 is released, the elastic recovery of bellows 40 makes the first piston 12 slide upwards again, thus creating inside the cylindrical chamber 13 a depression and, therefore, a lifting of the second piston 120 because of the pressure of the liquid coming up from the container following direction 140 and which, through the feeding hole 14 and the holes 15 drilled in the second piston 120, fills the cylindrical chamber 13.

At this point, by pressing downward again the dispensing element, the first piston 12 descends together with the second piston 120, whose second valvular elements 18 intercept again the feeding hole 14. The descent of the first piston 12 compresses the liquid present in the chamber 13 which, as can be observed in FIG. 3, flows following direction 131 from the cylindrical chamber 13 into the tubular chamber 160 through duct 122, which is no longer obstructed by ball 22. The pression of the liquid inside said tubular chamber 160 lifts said first valvular means 20 and enters into the dispensing channel 21 from which it pours out.

Once the dispensing has been completed, the released of the dispensing element 10 permits the dispensing element 10 itself to slide back up into its resting position because of the action of the elastic recovery of bellows 40, thereby causing again the refill of the cylindrical chamber 13 with the liquid coming from the container.

The pump 1 is thus ready to perform a new dispensing action as soon as the dispensing element 10 is pressed downwards again.

Figure 3:
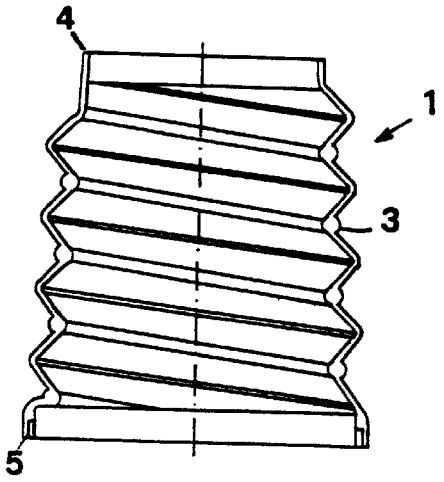
FIG. 3 shows the suction pump of FIG. 2 during the dispensing phase.
Figure 4:
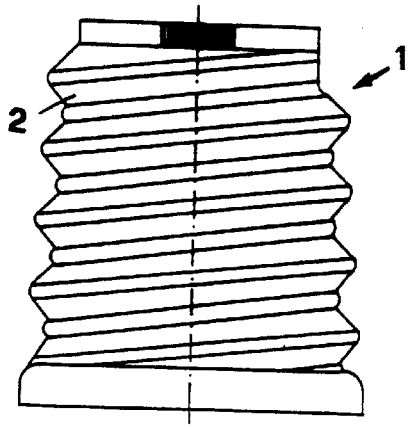
FIG. 4 shows in a cross-section the bellows of the pump according to the invention, presenting a cone-shaped profile.
Figure 5:
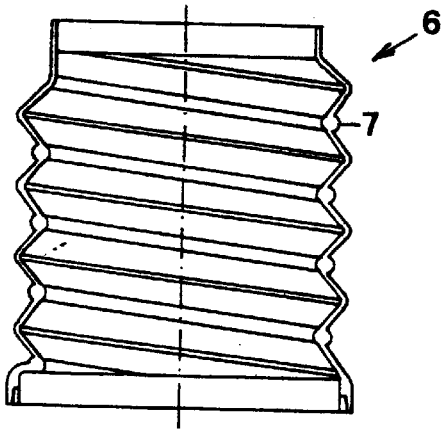
FIG. 5 shows a no-cutaway lateral view of the bellows of FIG. 4.

It is important to observe that the elastic bellows 40 described and represented in the FIGS. 1, 2 and 3, is also represented in the FIGS. 4 and 5. It presents a tapered profile and its lateral surface, indicated as a whole with 50, has the shape of a spiral. More specifically, said spiral shape permits the realization of bellows 40 through injection moulding, since the spiral shape allows by rotation the extraction of the snapping tool once the bellows has been moulded.

Figure 8:
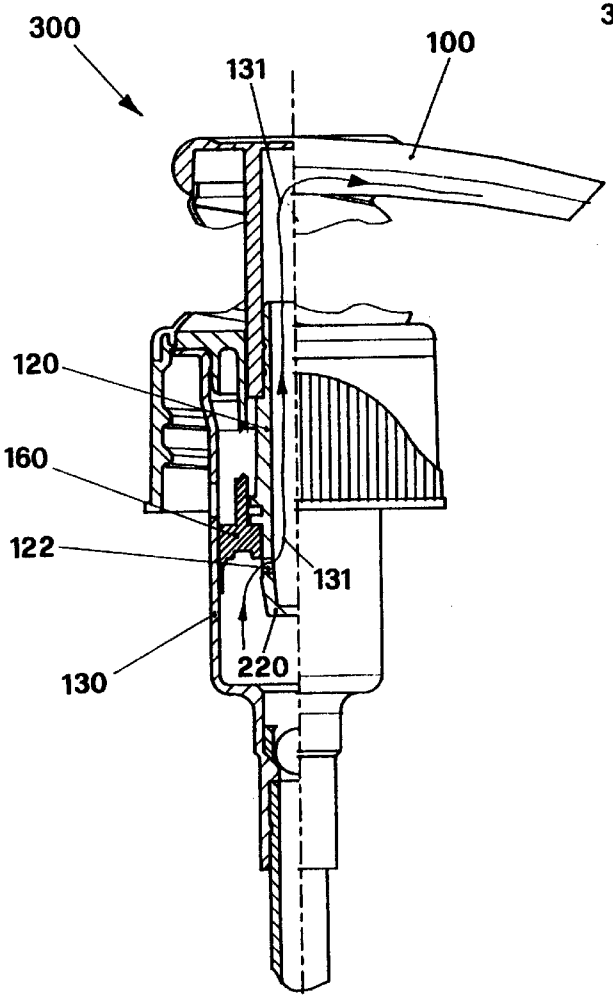
FIG. 8 shows in a cross-section the enlarged profile of the spiral which forms the lateral surface of the bellows belonging to the pump according to the invention.

As can be observed in the detail represented in FIG. 8, the elastic bellows 40 incorporates spring 63 which is obtained in a single piece together with the bellows and its turns are located in correspondence with the contraction areas of the spiral 80 which forms the lateral surface 50 of the bellows.

In particular, the spiral 80 presents, in its longitudinal section, an essentially symmetrical profile in relation to its axis 70 which is slanted in relation to the longitudinal axis 400 of bellows 40. The presence of such a spring 63, together with the essentially symmetrical profile of each spiral 80, is such as to allow the greatest build-up of elastic power during the pressing action. Said elastic power is released when the bellows elastically return into its resting position, once the axial force which has caused the pressing stops.

During the return of the dispensing element 10 into its resting position, this considerable amount of built-up elastic power permits a great suction of liquid which is transferred from the container into the cylindrical chamber 13 by means of the action of the first piston 12.

The possibility for the bellows to build-up and then release another amount of elastic power is further increased since, as can be observed in FIG. 8, the walls 60 of spiral 80 also present curved profiles 62 having an outward convexity, which make each spiral essentially acquire the shape of Belleville washers thus permitting a good axial force after the pressing action.

Therefore, with such a configuration of the elastic bellows 40, it is possible to obtain elastic returns having values which can be compared with those obtained by using metal springs, with the advantage of achieving, at the same time, the possibility of a complete and immediate recovery and recycling of the material which composes the pump.

Figure 6:
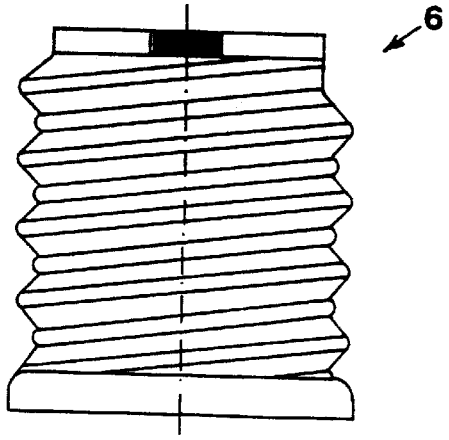
FIG. 6 shows in a cross-section a different embodiment of the bellows belonging to the pump according to the invention and realized with a cylindrical profile.
Figure 7:
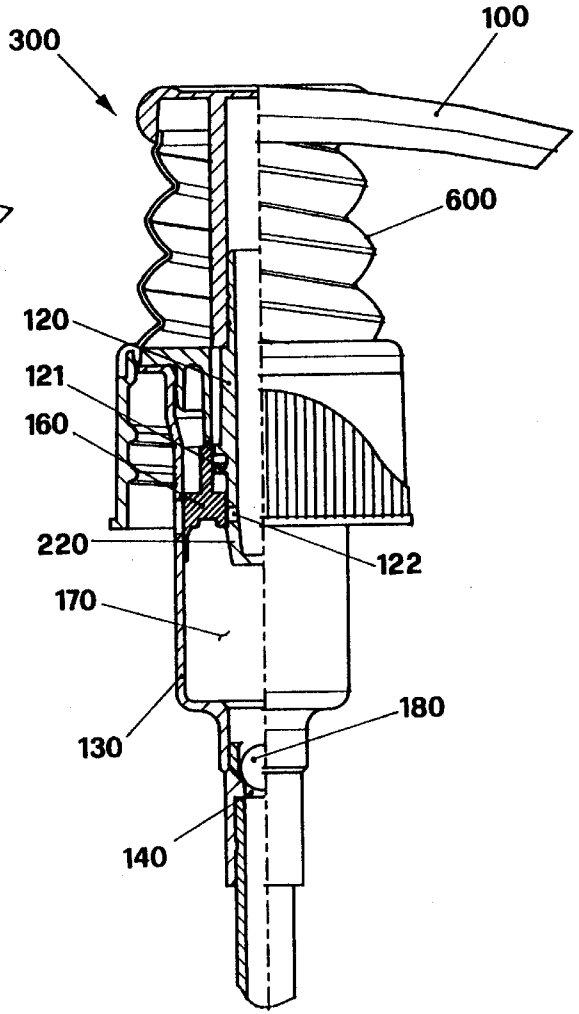
FIG. 7 shows a no-cutaway lateral view of the bellows of FIG. 6.

In a different embodiment, as can be observed in the FIGS. 6 and 7, the bellows according to the invention, indicated as a whole with 500, can also be obtained with a cylindrical profile, yet maintaining the spiral 510 which forms its lateral surface 600, the symmetrical profile in relation to the axis of inclination 700 of the spiral and the same structure which incorporates the spring.

A different embodiment of the pump according to the invention is represented in the FIGS. 9 and 10 wherein it can be observed that said pump, indicated as a whole with 300, foresees a different embodiment of the pistons with which it is complete. In fact, it can be observed that, when the dispensing element 100 is pressed downwards, it also drags a first piston 320 connected with it, which presents internally a cylindrical chamber 321 and slides inside a cylindrical chamber 330 by means of the interposition of a second piston 360. Said first piston 320, during its downstroke, also drags the second piston 360 by means of the projections 421, so as to obstruct passage 240 by means of the valvular element consisting of ball 180.

When the dispensing element 100 is released, as a consequence of the elastic return of bellows 800, the first piston 320 and the second piston 360 also slide upwards. This creates a depression inside the cylindrical chamber 330. Said depression generates a suction of liquid from the container below which flows through passage 240 no longer obstructed by the valvular element 180 and which refills the cylindrical chamber 330.

By pressing down again dispenser 100 the liquid contained in the cylindrical chamber 330 is compressed and enters following direction 331 into the first piston 320 through opening 322 obtained in the first piston 320 which acts as a valvular element by co-operating with said second piston 360. The liquid then flows outwards through dispenser 100.

In this different embodiment, too, bellows 800 presents its lateral surface in the shape of a spiral so that it can be manufactured by injection moulding. Moreover, each of the folds which form the lateral surface of said bellows presents in a longitudinal cross-section a symmetrical profile in relation to the axis of inclination of the fold itself, so as to create a strong elastic return and, as a consequence, a great depression within chamber 330 when bellows 400 goes back to its resting position.

On the basis of what has been described, it is easy to understand that the pump according to the invention together with the described elastic bellows, reaches all the proposed purposes and also permits to obtain all the mentioned advantages.

It is obvious that the pump according to the invention can also be manufactured with different shapes and dimensions concerning, for instance, the dispensing element or the collar for its application on the container. The latter can also acquire any shape or dimension and can be used for more or less thick liquids.

All mentioned variations and others are to be considered as belonging to the scope of the present invention.

I claim:

1. An all plastic pump for dispensing liquids adapted to be connected to a container for such liquids, comprising:

a cylindrical chamber having a feed hole in flow communication with said container when connected thereto for receiving said liquid to be dispensed through the feed hole;

at least one piston axially slidable within said cylindrical chamber between dispensing and rest positions and including a tubular chamber therein;

valve means located within the cylindrical chamber and movable with respect to the piston between open and closed positions for allowing dispensing of liquids as the piston moves from the rest position to the dispensing position;

at least one elastic bellows coupled to the piston and having walls in the shape of a spiral having turns and corresponding contraction areas for returning, by elastic recovery, said piston to the rest position once dispensing has occurred, wherein said elastic bellows includes an integral spring formed of plastic arranged in correspondence with the contraction areas of the spiral the turns having a thickness for producing a stiffening rib in an external surface of the spiral, the walls of the spiral forming a surface of the bellows having an outwardly convex profile.

2. A pump according to claim 1, wherein the spiral has an axis of inclination and the walls have an essentially symmetrical profile in relation to said axis of inclination.

3. A pump according to claim 1, wherein said bellows has a cylindrical shape.

4. A pump according to claim 1, wherein said bellows has the shape of a truncated-cone.

5. A pump according to claim 1, having a dispensing duct and wherein said at least one piston includes a first piston, the tubular chamber has an end connected with the cylindrical chamber and an opposite end being connected to the dispensing duct.

6. A pump according to claim 5, including a ball member interposed between said dispensing duct and said tubular chamber.

7. A pump according to claim 5, wherein said at least one piston includes a tubular member a second piston including a stem portion axially slidable within said tubular member and wherein the valve means is interposed between the cylindrical chamber and the feed hole for receiving the liquid from the container, and further including a duct in flow communication between the cylindrical chamber and the tubular chamber.

8. A pump according to claim 7, wherein said valve means comprises a first valve means including a ball located at an end of the stem of the second piston, said ball being located within said tubular chamber for obstructing said duct; and second valve means comprising a beveled end portion of said second piston for obstruction of the feed hole.

9. A pump according to claim 1, wherein said at least one piston comprises a first piston and a second piston, and said second piston is located between the first piston and the cylindrical chamber coaxially therewith, and wherein said valve means is located for cooperation with said first piston and said cylindrical chamber for said feed hole and for communicating the cylindrical chamber with the tubular chamber.

10. A dosing pump for dispensing liquid adapted to be connected to a container for such liquid, comprising:

a dispensing element;

a cylindrical chamber in flow communication with the dispensing element and having an inlet for receiving the liquid to be dispensed from the container when connected thereto;

a piston slidably mounted within the cylindrical chamber having a stroke for motion between a rest position and a dispensing position at corresponding opposite rest and dispensing ends of the stroke;

valve means coaxially located with respect to the cylindrical chamber, and movable with respect to the piston between open and closed positions, and including a first valve element in communication with the inlet operative to close when the piston is urged in a direction towards the dispensing position to block liquid flow into said cylindrical chamber, and to open when piston is urged in a direction towards the rest position for allowing liquid flow through the inlet and into the chamber, and a second valve element located between the cylindrical chamber and the dispensing element and operative between open and closed positions for allowing liquid flow from the cylindrical chamber to the dispensing element when the piston is urged in the direction of the dispensing position, and operative to block liquid flow to the dispensing element when the piston is released;

an elastic element for urging the piston to its rest position from the dispensing position, wherein the elastic element includes a plastic bellows formed by injection molding and having a sidewall in the form of a spiral shaped side surface said sidewall of said spiral formed with contracted areas including an integral spring portion and an outwardly convex curved profile extending from said contracted areas.

11. The dosing pump according to claim 10, wherein the first valve element comprises a ball located at the inlet to the cylindrical chamber.

12. The dosing pump according to claim 10, wherein the second valve element comprises a first ball located between the piston and the dispensing element.

13. The dosing pump according to claim 12, wherein the second valve element includes a second ball located between the piston and the first ball.

14. The dosing pump according to claim 10, wherein the second valve element comprises a hollow cylinder having a sidewall portion coaxial with and slideable within the piston, and having an open distal end and an aperture in the sidewall portion proximate the piston, said hollow cylinder being movable with the piston between respective closed and open positions and in flow communication with the cylindrical chamber when the piston is moved towards the dispensing position and closed for blocking flow communication with the cylindrical chamber when the piston is moved away from the dispensing position towards the rear position.

15. The dosing pump according to claim 10, wherein the first valve element comprises a bottom of the valve slidable within the cylindrical chamber for engaging the inlet of the cylindrical chamber when the piston is moved to the dispensing position.

16. The dosing pump according to claim 15, wherein the bottom of the valve has holes in communication with the cylindrical chamber.

17. The dosing pump according to claim 10, wherein the sidewall of the plastic bellows is in the form of at least one of a conic and cylindrical spiral.

18. The dosing pump according to claim 10, wherein the spiral shaped sidewall has protruding and receding coaxial spiral elements, and wherein the spiral elements further include a reinforcing rib portion.

* * * * *